US008193888B2

(12) United States Patent
Tsuduki et al.

(10) Patent No.: US 8,193,888 B2
(45) Date of Patent: Jun. 5, 2012

(54) LAMINATED INDUCTOR

(75) Inventors: Keiichi Tsuduki, Kyoto-fu (JP); Yoshiko Banno, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/188,650

(22) Filed: Jul. 22, 2011

(65) Prior Publication Data

US 2011/0279213 A1 Nov. 17, 2011

Related U.S. Application Data

(63) Continuation of application No. PCT/JP2009/070975, filed on Dec. 16, 2009.

(30) Foreign Application Priority Data

Jan. 22, 2009 (JP) ..... 2009-012157

(51) Int. Cl.
*H01F 27/02* (2006.01)

(52) U.S. Cl. ..... 336/83

(58) Field of Classification Search ..... 336/65, 336/83, 200, 206–208, 232, 178
See application file for complete search history.

(56) References Cited

U.S. PATENT DOCUMENTS

| | | | | |
|---|---|---|---|---|
| 6,498,553 | B1 * | 12/2002 | Tanaka et al. | 336/83 |
| 6,956,455 | B2 * | 10/2005 | Tokuda et al. | 336/83 |
| 7,605,682 | B2 * | 10/2009 | Nakao et al. | 336/200 |
| 7,907,044 | B2 * | 3/2011 | Tada et al. | 336/200 |

FOREIGN PATENT DOCUMENTS

| | | | |
|---|---|---|---|
| JP | 61-004111 | | 1/1986 |
| JP | 2005-045108 | A | 2/2005 |
| JP | 2006-216916 | A | 8/2006 |
| JP | 2006-318946 | A | 11/2006 |
| WO | 2007/088914 | A1 | 8/2007 |
| WO | 2008/018187 | A1 | 2/2008 |

OTHER PUBLICATIONS

International Search Report; PCT/JP2009/070975; Mar. 2, 2010.
Written Opinion of the International Searching Authority; PCT/JP2009/070975; Mar. 2, 2010.

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

This disclosure provides a laminated inductor capable of suppressing concentration of magnetic gap portions, preventing local magnetic saturation, and obtaining excellent DC superposition characteristics. In an embodiment of a laminated inductor, magnetic layers and coil conductors are alternately laminated. The laminated inductor includes plural first mixed layers and plural second mixed layers. Each first mixed layer includes a first nonmagnetic material portion between ones of the conductive patterns overlapping in a lamination direction and a second nonmagnetic material portion that is inside the coil conductor and connected to the first nonmagnetic material portion. Each second mixed layer includes a nonmagnetic material portion between ones of the conductive patterns overlapping in the lamination direction and a nonmagnetic material portion that is outside the coil conductor and is connected to the first nonmagnetic material portion. The plural first mixed layers and the plural second mixed layers are formed as different layers.

6 Claims, 4 Drawing Sheets

LAMINATED INDUCTOR

CROSS REFERENCE TO RELATED APPLICATIONS

The present application is a continuation of International Application No. PCT/JP2009/070975, filed Dec. 16, 2009, which claims priority to Japanese Patent Application No. 2009-012157 filed Jan. 22, 2009, the entire contents of each of these applications being incorporated herein by reference in their entirety

TECHNICAL FIELD

The present invention relates to laminated inductors including magnetic layers and conductive patterns alternately laminated, and, more particularly, to a laminated inductor including mixed layers having a magnetic portion and a nonmagnetic portion.

BACKGROUND

Many inductance elements, each obtained by winding a coil conductor around a magnetic core, have been generally used in circuits of electronic components. In recent years, a laminated inductor is often used instead of such an inductance element to meet a miniaturization demand.

In general, in a laminated inductor, magnetic layers and conductive patterns are alternately laminated and the conductive patterns are electrically connected to one another such that that conductive patterns function as a coil conductor. However, when a direct current is applied to such a laminated inductor, an inductance value rapidly reduces as a result of an occurrence of magnetic saturation at magnetic substances in accordance with the increase in current. That is, DC superposition characteristics deteriorate.

Japanese Unexamined Patent Application Publication No. 2006-318946 (Patent Document 1) discloses a laminated inductor including a magnetic gap portion obtained by replacing a part of a magnetic layer with a nonmagnetic substance. Using the configuration of a laminated inductor disclosed in Patent Document 1, it is possible to suppress magnetic saturation at the time of application of a direct current to the laminated inductor and improve DC superposition characteristics.

SUMMARY

The present disclosure provides a laminated inductor capable of obtaining more sufficient and excellent DC superposition characteristics and suppressing external magnetic leakage.

In an embodiment of a laminated inductor according to the disclosure, magnetic layers and conductive patterns are alternately laminated, and the conductive patterns are electrically connected to one another and function as a coil conductor. The laminated inductor includes a plurality of first mixed layers each obtained by forming a first portion between ones of the conductive patterns overlapping in a lamination direction and a second portion that is inside the coil conductor and is connected to the first portion with a nonmagnetic material and a plurality of second mixed layers each obtained by forming the first portion between ones of the conductive patterns overlapping in the lamination direction and a third portion that is outside the coil conductor and is connected to the first portion with the nonmagnetic material. The plurality of first mixed layers and the plurality of second mixed layers are formed as different layers.

In another embodiment of a laminated inductor according to the disclosure, magnetic layers and conductive patterns are alternately laminated and the conductive patterns are electrically connected to one another and function as a coil conductor. The laminated inductor includes plural first mixed layers and plural second mixed layers. Each first mixed layer includes a nonmagnetic material portion inside the coil conductor. Each second mixed layer each includes a nonmagnetic material portion outside the coil conductor. The plural first mixed layers and the plural second mixed layers are formed as different layers.

In a more specific embodiment of a laminated inductor according to the disclosure, the plural first mixed layers may be positioned nearer to a center of the laminated coil conductor in the lamination direction than the plural second mixed layers.

In another more specific embodiment of a laminated inductor according to the disclosure, the plural first mixed layers and the plural second mixed layers may be positioned symmetrically with respect to a center of the laminated coil conductor in the lamination direction.

DETAILED DESCRIPTION

Figure 1:
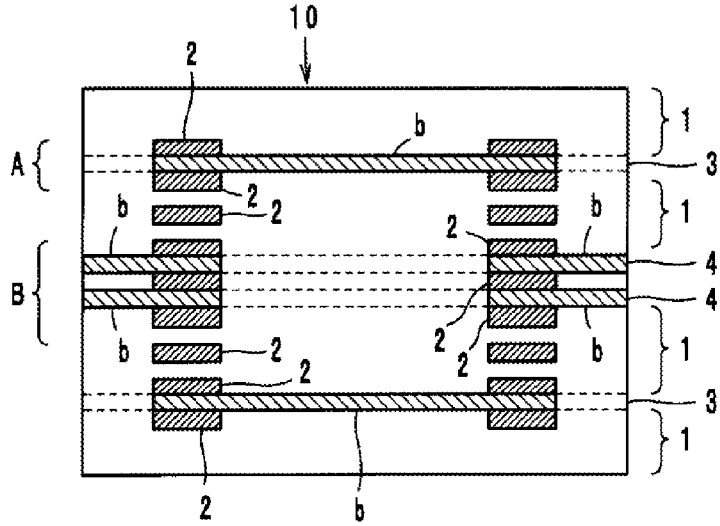
FIG. 1 is a cross-sectional view of a laminated inductor according to a first exemplary embodiment.

The inventors realized that in the laminated inductor disclosed in Patent Document 1, the magnetic gap portion made of a nonmagnetic substance is disposed only outside a coil conductor. Accordingly, it is effective to a certain extent for the improvement of DC superposition characteristics, but sufficient DC superposition characteristics cannot be obtained. In addition, the amount of external magnetic leakage in the laminated inductor disclosed in Patent Document 1 is increased because many magnetic gaps are formed outside the coil conductor.

Exemplary embodiments of the present disclosure that can address these shortcomings will now be described with reference to the accompanying drawings. In the drawings, the same reference numeral is used to represent the same component or the same part so as to avoid repeated explanation.

In the following exemplary embodiments, a conductive material having silver or a silver alloy as a major component is used to form a conductive pattern, a magnetic material made of Ni—Cu—Zn ferrite is used to form a magnetic layer, and a nonmagnetic material made of Cu—Zn ferrite is used to form first and second mixed layers. It is to be noted, however, that the above-described materials are for illustrative purposes only.

FIG. 1 is a cross-sectional view of a laminated inductor 10 according to a first exemplary embodiment. Referring to FIG. 1, in the laminated inductor 10, magnetic layers 1, first mixed layers 3, second mixed layers 4, and conductive patterns 2 are laminated. The conductive patterns 2 are formed on layers so that each of the conductive patterns 2 has a one-turn length on a corresponding layer and the conductive patterns 2 overlap one another in a lamination (i.e., stacking) direction. The conductive patterns 2 on the layers are electrically connected to one another through via hole conductors (not illustrated), so that the conductive patterns 2 collectively function as a coil conductor.

Figure 2:
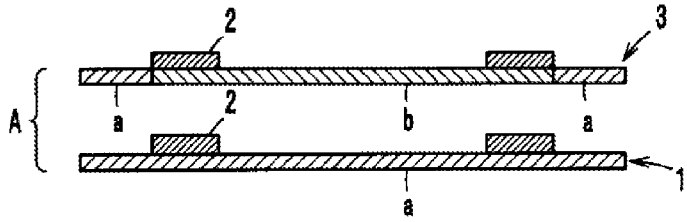
FIG. 2 is an exploded cross-sectional view of an area A according to the first exemplary embodiment.

The first mixed layer 3 is obtained by replacing a part of a magnetic material with a nonmagnetic material. More specifically, as illustrated in FIG. 2, the first mixed layer 3 is obtained by forming a part of a layer between the conductive patterns 2 overlapping in the lamination direction and a part of the layer inside the coil conductor with a nonmagnetic material b and forming the other part of the layer with a magnetic material a. The nonmagnetic part of the layer between the overlapping conductive patterns 2 and the nonmagnetic part of the layer inside the coil conductor are connected.

Figure 3:
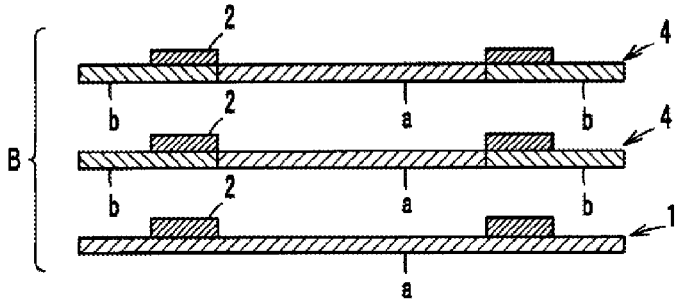
FIG. 3 is an exploded cross-sectional view of an area B according to the first exemplary embodiment.

The second mixed layer 4 is obtained by replacing a part of a magnetic material with a nonmagnetic material. More specifically, as illustrated in FIG. 3, the second mixed layer 4 is obtained by forming a part of a layer between the conductive patterns 2 overlapping in the lamination direction and a part of the layer outside the coil conductor with the nonmagnetic material b and forming the other part of the layer with the magnetic material a. The nonmagnetic part of the layer between the overlapping conductive patterns 2 and the nonmagnetic part of the layer outside the coil conductor are connected.

The first mixed layer 3 and the second mixed layer 4 are formed as different layers, that is, are in different levels.

By configuring the laminated inductor 10 as described previously, it is possible to suppress concentration of magnetic gap portions and prevent local magnetic saturation. Accordingly, excellent DC superposition characteristics can be obtained. Furthermore, the amount of external magnetic leakage can be reduced.

Figure 4:
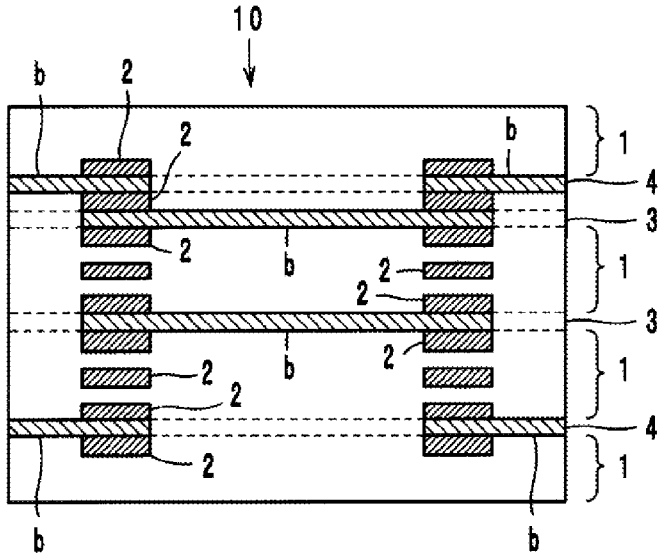
FIG. 4 is a cross-sectional view of a laminated inductor according to a second exemplary embodiment.

FIG. 4 is a cross-sectional diagram of the laminated inductor 10 according to a second exemplary embodiment. In the second exemplary embodiment, the first mixed layers 3 described in the first exemplary embodiment are nearer to the center of the laminated coil conductor than the second mixed layers 4.

Like in the first exemplary embodiment, in this embodiment, it is possible to suppress concentration of magnetic gap portions and prevent local magnetic saturation.

Figure 5:
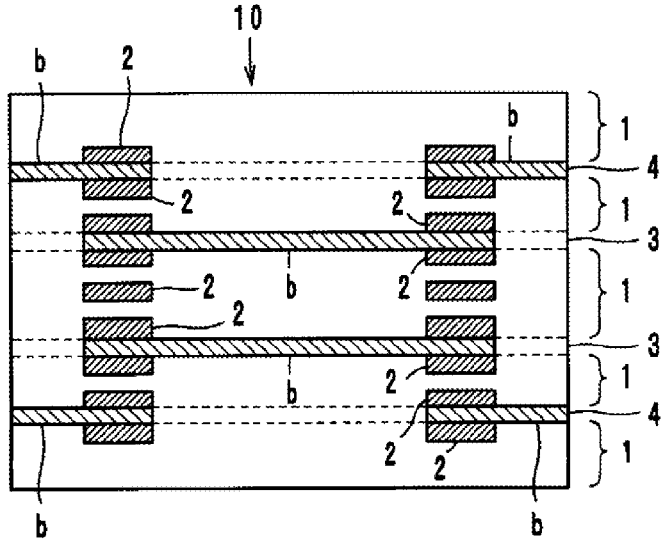
FIG. 5 is a cross-sectional view of a laminated inductor according to a third exemplary embodiment.

FIG. 5 is a cross-sectional diagram of the laminated inductor 10 according to a third exemplary embodiment. In the third exemplary embodiment, the first mixed layers 3 and the second mixed layers 4 described in the first exemplary embodiment are symmetric with respect to the center of the laminated coil conductor in the lamination direction.

According to this embodiment, as compared with the first and second exemplary embodiments, it is possible to more effectively suppress concentration of magnetic gap portions and prevent local magnetic saturation.

Figure 6:
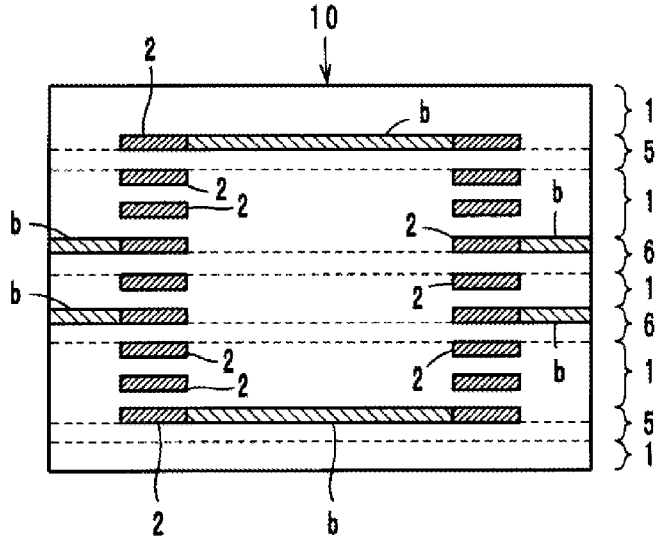
FIG. 6 is a cross-sectional view of a laminated inductor according to a fourth exemplary embodiment.
Figure 7:
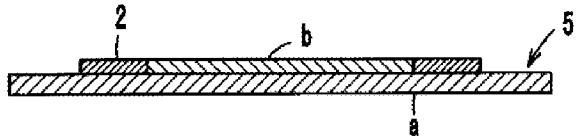
FIG. 7 is a cross-sectional view of a first mixed layer according to the fourth exemplary embodiment.
Figure 8:
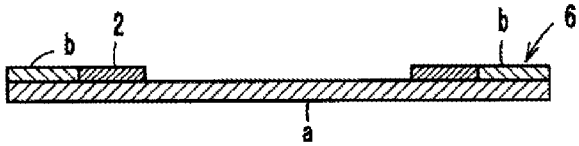
FIG. 8 is a cross-sectional view of a second mixed layer according to the fourth exemplary embodiment.
Figure 9:
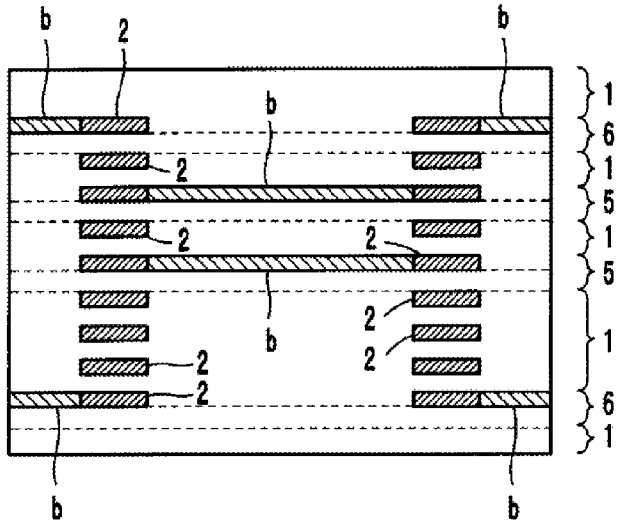
FIG. 9 is a cross-sectional view of a laminated inductor according to a fifth exemplary embodiment.
Figure 10:
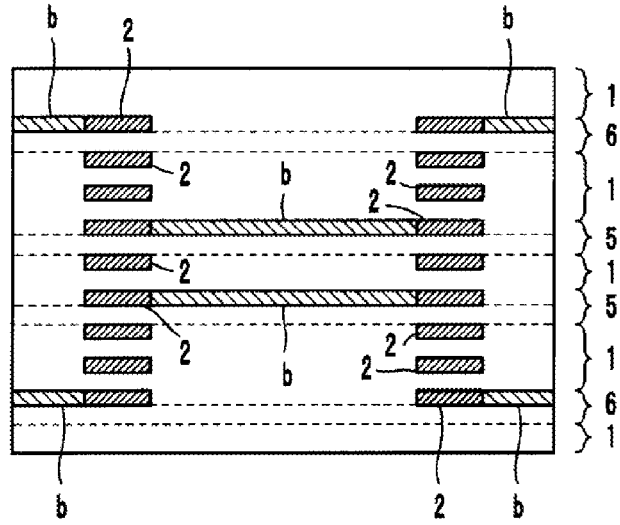
FIG. 10 is a cross-sectional view of a laminated inductor according to a sixth exemplary embodiment.

FIGS. 6, 9, and 10 are cross-sectional diagrams of the laminated inductors 10 according to fourth, fifth, and sixth exemplary embodiments, respectively. In the laminated inductors 10 according to these embodiments, the magnetic layers 1, first mixed layers 5, second mixed layers 6, and the conductive patterns 2 are laminated. As illustrated in FIG. 7, the first mixed layer 5 is obtained by using the nonmagnetic material b to form only a portion that is inside a coil conductor (the conductive pattern 2) on a layer made of the magnetic material a. As illustrated in FIG. 8, the second mixed layer 6 is obtained by using the nonmagnetic material b to form only a portion that is outside a coil conductor (the conductive pattern 2) on a layer made of the magnetic material a.

In the fourth exemplary embodiment illustrated in FIG. 6, the first mixed layer 5 and the second mixed layer 6 are formed as different layers. In the fifth exemplary embodiment illustrated in FIG. 9, like in the second exemplary embodiment, the first mixed layers 5 are nearer to the center of the laminated coil conductor than the second mixed layers 6. In the sixth embodiment illustrated in FIG. 10, like in the third exemplary embodiment, the first mixed layers 5 and the second mixed layers 6 are symmetric with respect to the center of the laminated coil conductor in the lamination direction. By configuring the laminated inductor 10 as described previously, it is possible to suppress the concentration of magnetic gaps and prevent local magnetic saturation. Accordingly, excellent DC superposition characteristics can be obtained. Furthermore, the amount of external magnetic leakage can be reduced.

Figure 11:
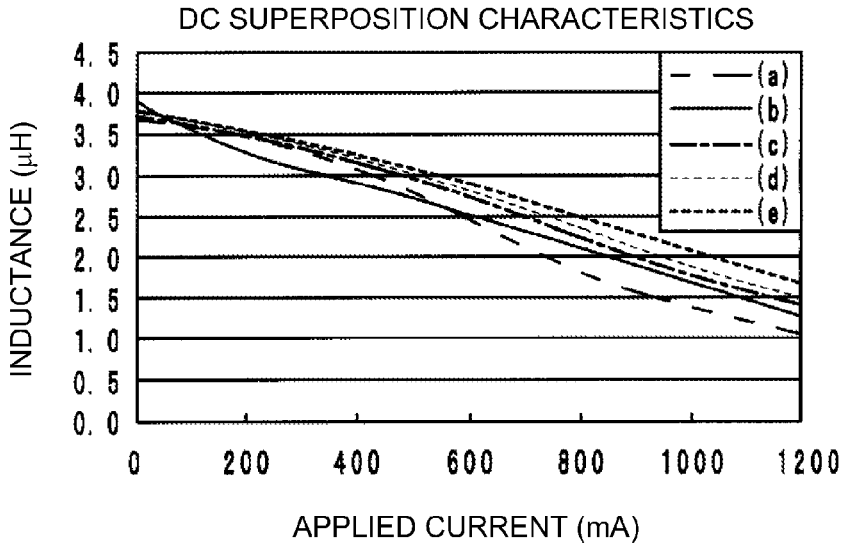
FIG. 11 is a graph indicating the comparison of DC superposition characteristics between the present disclosure and related art.

FIG. 11 illustrates the comparison of DC superposition characteristics between a product according to the present disclosure and a product in the related art. A vertical axis represents an inductance value, and a horizontal axis represents the value of an applied direct current. In the drawing, (a) denotes the DC superposition characteristics of a product in the related art, for example, a product disclosed in Patent Document 1 in which a nonmagnetic layer is formed only outside a coil conductor, (b) denotes the DC superposition characteristics of a product in the related art in which a nonmagnetic layer is formed only inside a coil conductor, and (c), (d), and (e) denote the DC superposition characteristics according to the first, second, and third embodiments, respectively.

As is apparent from this graph, the amount of reduction in an inductance value with the increase in an applied direct current in the case of (c), (d), and (e) is lower than that in the case of (a) and (b). Therefore, according to embodiments consistent with the present disclosure, it is possible to suppress concentration of magnetic gap portions and prevent local magnetic saturation. As a result, excellent DC superposition characteristics can be obtained.

In embodiments according to the disclosure, a first mixed layer obtained by forming a portion inside a coil conductor with a nonmagnetic material and a second mixed layer obtained by forming a portion outside the coil conductor with the nonmagnetic material are laminated as different layers. Accordingly, as compared with a structure in which a nonmagnetic substance is formed only outside a coil conductor, the concentration of magnetic gap portions is suppressed and local magnetic saturation can be prevented. As a result, excellent DC superposition characteristics can be obtained. In addition, external magnetic leakage can be suppressed.

Embodiments according to the disclosure can be useful in applications that utilize a laminated inductor, and, in particular, can have an advantage in suitability for obtaining excellent DC superposition characteristics and suppressing external magnetic leakage.

It should be understood that the above-described embodiments are illustrative only and that variations and modifications will be apparent to those skilled in the art without departing from the scope and spirit of the disclosure. The scope of the invention should be determined in view of the appended claims and their equivalents.

What is claimed is:

1. A laminated inductor in which magnetic layers and conductive patterns are alternately laminated and the conductive patterns are electrically connected to one another and function as a coil conductor, comprising:

plural first mixed layers, each first layer including a first nonmagnetic material portion between ones of the conductive patterns overlapping in a lamination direction and a second nonmagnetic material portion that is inside the coil conductor and connected to the first nonmagnetic material portion; and plural second mixed layers, each second layer including a third nonmagnetic material portion between ones of the conductive patterns overlapping in the lamination direction and a fourth nonmagnetic material portion that is outside the coil conductor and connected to the first nonmagnetic material portion, and wherein the plural first mixed layers and the plural second mixed layers are formed as different layers.

2. The laminated inductor according to claim 1, wherein the plural first mixed layers are nearer to a center of the laminated coil conductor in the lamination direction than the plural second mixed layers.

3. The laminated inductor according to claim 2, wherein the plural first mixed layers and the plural second mixed layers are symmetric with respect to the center of the laminated coil conductor.

4. A laminated inductor in which magnetic layers and conductive patterns are alternately laminated and the conductive patterns are electrically connected to one another and function as a coil conductor, comprising:

plural first mixed layers, each first mixed layer including a nonmagnetic material portion inside the coil conductor; and plural second mixed layers, each second mixed layer including a nonmagnetic material portion outside the coil conductor, and wherein the plural first mixed layers and the plural second mixed layers are formed as different layers.

5. The laminated inductor according to claim 4, wherein the plural first mixed layers are nearer to a center of the laminated coil conductor in a lamination direction than the plural second mixed layers.

6. The laminated inductor according to claim 5, wherein the plural first mixed layers and the plural second mixed layers are symmetric with respect to the center of the laminated coil conductor.

* * * * *